US011064743B2

(12) United States Patent
Nack

(10) Patent No.: US 11,064,743 B2
(45) Date of Patent: Jul. 20, 2021

(54) GARMENTS FOR PROTECTING BACKS OF HANDS

(71) Applicant: Hand Temple, Boulder, CO (US)

(72) Inventor: Amy E. Nack, Boulder, CO (US)

(73) Assignee: Hand Temple, Boulder, CO (US)

( * ) Notice: Subject to any disclaimer, the term of this patent is extended or adjusted under 35 U.S.C. 154(b) by 0 days.

(21) Appl. No.: 16/518,517

(22) Filed: Jul. 22, 2019

(65) Prior Publication Data

US 2020/0022429 A1 Jan. 23, 2020

Related U.S. Application Data

(63) Continuation of application No. 29/657,417, filed on Jul. 22, 2018, now Pat. No. Des. 889,068.

(60) Provisional application No. 62/701,817, filed on Jul. 22, 2018.

(51) Int. Cl.
*A41D 13/08* (2006.01)

(52) U.S. Cl.
CPC ..... *A41D 13/084* (2013.01); *A41D 2400/26* (2013.01)

(58) Field of Classification Search
CPC ..... A41D 13/084
USPC ..... 2/159
See application file for complete search history.

(56) References Cited

U.S. PATENT DOCUMENTS

| | | | | |
|---|---|---|---|---|
| 1,423,546 | A * | 7/1922 | Speer | A41D 19/0006 2/164 |
| D118,372 | S | 1/1940 | Guay | |
| 2,344,080 | A | 3/1944 | Burgett | |
| 3,037,209 | A | 6/1962 | Applegate et al. | |
| 3,994,025 | A * | 11/1976 | Petroski | A41D 13/081 2/20 |
| D257,408 | S | 10/1980 | Talty | |
| D351,930 | S | 10/1994 | Snider et al. | |
| D385,666 | S | 10/1997 | Abreu | |
| 6,729,979 | B1 | 5/2004 | Sullivan | |
| RE38,948 | E * | 1/2006 | Redman | 2/159 |
| D632,401 | S | 2/2011 | Stevens | |
| 9,820,516 | B2 | 11/2017 | Ferrer | |
| 2012/0198598 | A1* | 8/2012 | Cohen | A41D 19/002 2/160 |

OTHER PUBLICATIONS

Avalon Forge Muffatee, posted at avalonforge.com, posting date not given, [online], [site visited Nov. 8, 2019]. Available from Internet, URL: http://www.avalonforge.com/MainMisc.htm (Year: 2019).

(Continued)

*Primary Examiner* — Gloria M Hale
(74) *Attorney, Agent, or Firm* — Elevated IP, LLC

(57) ABSTRACT

Open-palm, fingerless hand protection gloves comprising a dorsal portion, a wrist portion, and at least one finger loop, where the dorsal portion is crisscrossed proximal to the at least one finger loop, are disclosed herein. In an embodiment, a dorsal portion of a hand protective glove is not crisscrossed proximal to a finger loop. In some embodiments, a finger loop surrounds multiple fingers. In some embodiments, the hand protection glove may be a sun protection glove where at least the dorsal portion is formed of ultraviolet (UV) protective material.

20 Claims, 12 Drawing Sheets

(56) References Cited

OTHER PUBLICATIONS

Glove Palmless Sports, posted at amazon.com, posting date by Aug. 18, 2019, [online], [site visited Nov. 8, 2019]. Available from Internet, URL: https://www.amazon.com/Glove-Palmess-Flexibility-Protection-Lightweight/dp/B07TZ5YK4X?th=1 (Year: 2019).
Lefty's G-II Palmless Sunglove, posted at beartoothflyfishing.com, posting date not given, [online], [site visited Jan. 8, 2019]. Available from Internet, URL: https://www.beartoothflyfishing.com/product/3188/Leftys-G-II-Palmless-Sunglove-Large/ (Year: 2019).
RunLites Sling II LED Safety Lights, posted at amazon.com, posting date by Oct. 10, 2018, [online], [site visited Nov. 8, 2019]. Available from Internet, URL: https://us.amazon.com/RunLites-II-Patented-Rechargeable-Running-Walking/dp/B07BX5QQPF (Year: 2019).
Victorian Palmless mitten gloves, posted at vintagevisage.co.uk, posting date not given, [online], [site visited Nov. 8, 2019]. Available from Internet, URL: https://vintagevisage.co.uk/product_161_Palmless-mitten-gloves-knitting-pattern (Year: 2019).
Screen capture from amazon.com, accessed Jun. 10, 2018.
Screen capture from https://www.walmart.com, accessed Jun. 10, 2018.
Screen capture from sunprotectionclothingusa.com, accessed Jun. 10, 2018.

* cited by examiner

GARMENTS FOR PROTECTING BACKS OF HANDS

CROSS-REFERENCE TO RELATED APPLICATIONS

This application claims the benefit of and priority to U.S. Provisional Patent Application No. 62/701,817, filed Jul. 22, 2018, and U.S. patent application Ser. No. 29/657,417, filed Jul. 22, 2018, each of which is hereby incorporated by reference in its entirety.

BACKGROUND

The backs of human hands are exposed to large amounts of ultraviolet radiation and other damaging conditions that can lead to photo or physical damage, discoloration, scarring, thinning of the skin, and precancerous or cancerous conditions. Yet, hands are frequently left unprotected in warmer months of the year because chemical barriers easily wash and rub off and full-coverage gloves are hot, sweaty and difficult to maneuver.

Some fingerless gloves are available for specialty purposes, such as cycling and weightlifting. But gloves that are both fingerless and palmless are quite rare, existing mainly as evening gown fashion accessories or utilitarian gloves. For example, U.S. Pat. No. 9,820,516 discloses a fingerless and palmless glove anchored to the thumb and fifth finger for sport and work. This glove impedes spreading of the fingers and creates a webbed appearance. In addition, a palm less paddling glove with thumb, third and fifth finger attachments exists, but it is aesthetically unsuitable for daily wear and lacks the protection necessary to meet the needs of the wearer.

SUMMARY

Open-palm, fingerless gloves for protecting the backs of hands are disclosed herein. The palmless, fingerless gloves are fashionable and functional. They do not significantly diminish dexterity, mobility, tactility or natural grip, and they allow for heat dissipation from the palm of the hand. In some embodiments, the glove is a sun protective glove having at least a dorsal portion comprising ultraviolet protective material. In some embodiments, the dorsal portion of the glove is padded or reinforced to provide impact protection. In some embodiments, the glove has a minimum number of interdigital sections (i.e., finger loops) to increase user comfort during grip-intensive activities.

In an aspect, an open-palm, fingerless hand protection glove comprises a dorsal portion, an open palm area, a wrist portion, and at least one finger loop configured to surround multiple fingers.

In an aspect, an open-palm, fingerless hand protection glove consists essentially of a dorsal portion, an open palm area, a wrist portion, and at least one finger loop configured to surround multiple fingers.

In an embodiment, the multiple fingers are all of a wearer's first through fourth fingers.

In an embodiment, a finger end of the glove is substantially linear.

In an embodiment, the at least one finger loop forms a palmar finger end of the glove. In an embodiment, the at least one finger loop forms a palmar finger end of the glove and spans between a lateral edge and a medial edge of the glove.

In an aspect, an open-palm, fingerless hand protection glove comprises a dorsal portion, a wrist portion, and at least one finger loop, wherein the dorsal portion is crisscrossed proximal to the at least one finger loop.

In an aspect, an open-palm, fingerless sun protection glove comprises a dorsal portion formed of ultraviolet (UV) protective material, a wrist portion, and at least one finger loop, wherein the UV protective material of the dorsal portion is crisscrossed proximal to the at least one finger loop.

In an embodiment, the dorsal portion is configured to cover at least 80%, or at least 85%, or at least 90%, or at least 95%, or at least 99%, or 100% of the back of a wearer's hand. In an embodiment, "the back of a wearer's hand" excludes the backs of the fingers.

In an embodiment, a dorsal portion of a hand protective glove is not crisscrossed. In an embodiment, a dorsal portion of a hand protective glove is not crisscrossed proximal to a finger loop.

In an embodiment, the dorsal portion and the at least one finger loop are contiguous. In an embodiment, the dorsal portion, the wrist portion and the at least one finger loop are contiguous.

In an embodiment, the crisscross provides multi-directional force along an upper edge of the dorsal portion. In an embodiment, the dorsal portion is crisscrossed to form the at least one finger loop.

In an embodiment, the at least one finger loop comprises a plurality of finger loops and the dorsal portion is crisscrossed proximal to each of the finger loops.

In an embodiment, the UV protective material has an ultraviolet protection factor (UPF) of at least 15, or at least 30, or at least 40, or at least 50, or at least 60, or at least 70, or at least 100.

In an embodiment, the UV protective material may be a recycled or raw material selected from the group consisting of cotton, linen, hemp, polyester, nylon, spandex, polypropylene, denim, twill, canvas, wool, leather and combinations thereof.

In an embodiment, the UV protective material is moisture wicking.

In an embodiment, the UV protective material comprises an antibacterial agent.

In an embodiment, a glove further comprises a second material attached to at least a portion of an internal surface of the glove to produce a reversible glove that can be worn on an opposite hand. In an embodiment, the second layer of material is UV protective material or the second layer of material is not UV protective material.

In an embodiment, the wrist portion is sewn, velcroed, tied, crisscrossed, elastic, buttoned, snapped, magnetically fastened, mechanically fastened, and/or laser-cut as one piece.

In an embodiment, the wrist portion has a length between 0.5 inches and 36 inches, or between 0.5 inches and 20 inches, or between 0.5 inches and 12 inches, or between 0.5 inches and 6 inches, or between 0.5 inches and 3 inches. Wrist portions of various lengths produce gloves capable of extending to a wearer's wrist, forearm, elbow, bicep, armpit or anywhere in between.

In an embodiment, the wrist portion comprises a cuff, which is a distinct piece of material attached to at least the dorsal portion. The cuff may extend from the edge of the dorsal portion to a wearer's wrist, forearm, elbow, bicep or armpit.

In an embodiment, the wrist portion comprises a vent. For example, a vent may be disposed within a palmar surface of the wrist portion, a distal surface of the wrist portion or both. In an embodiment, the vent comprises mesh and/or sheer material. In an embodiment, the vent terminates at a hand seam, an arm seam or both.

In an embodiment, a finger loop is configured to surround a single finger or multiple fingers. For example, the single finger may be a thumb, a first finger, a second finger, a third finger or a fourth finger. In an embodiment, multiple fingers surrounded by a finger loop are selected from a combination of a wearer's first through fourth fingers. In an embodiment, the multiple fingers surrounded by a finger loop are all of a wearer's first through fourth fingers. In an embodiment, a glove comprises a plurality of finger loops, each loop individually configured to surround one of a wearer's fingers.

An open-sole, toeless foot protection glove with any or all of the features disclosed herein is also contemplated. Such a glove will have a dorsal portion, an ankle portion and at least one toe loop. In an embodiment, the at least one toe loop is configured to surround multiple toes. In an embodiment, the dorsal portion is crisscrossed proximal to the at least one toe loop.

Components disclosed herein may be manufactured by techniques known in the art, including, but not limited to, sewing, weaving, knitting, crocheting, laser cutting, seam sealing, ultrasonic welding and the like.

BRIEF DESCRIPTION OF THE DRAWINGS

Illustrative embodiments of the present invention are described in detail below with reference to the attached drawings, wherein.

It is understood that while a left-handed glove is illustrated in the figures, the right-handed glove is a mirror image thereof.

DETAILED DESCRIPTION

In general, the terms and phrases used herein have their art-recognized meaning, which can be found by reference to standard texts, journal references and contexts known to those skilled in the art. The following definitions are provided to clarify their specific use in the context of this description.

A "system" is a combination of components operably connected to produce one or more desired functions.

A "component" is used broadly to refer to an individual part of a system.

"Contiguous" refers to areas, components, materials or layers that are directly touching or connected.

"Proximal" and "distal" refer to the relative positions of two or more objects, planes or surfaces. For example, an object that is close in space to a reference point relative to the position of another object is considered proximal to the reference point, whereas an object that is further away in space from a reference point relative to the position of another object is considered distal to the reference point.

The terms "direct and indirect" describe the actions or physical positions of one component relative to another component. For example, a component that "directly" acts upon or touches another component does so without intervention from an intermediary. Contrarily, a component that "indirectly" acts upon or touches another component does so through an intermediary (e.g., a third component).

An "ultraviolet protection factor (UPF)" is the ratio of ultraviolet (UV) radiation without and with the protection of a material. For example, a UPF of 30 means that 1 out of 30 units of UV will pass through the material.

The terms "open-palm" and "palm less" are used interchangeably herein to refer to gloves that are substantially void of material covering the palm region of a human hand. Such gloves may, for example, improve tactility, grip and comfort relative to a full-coverage glove.

The terms "fingerless" and "toeless" are used herein to refer to gloves that are substantially void of material encapsulating the fingers or toes of a human hand or foot.

Exemplary gloves can be seen in FIGS. 1-16, which are described hereafter.

Figure 1:
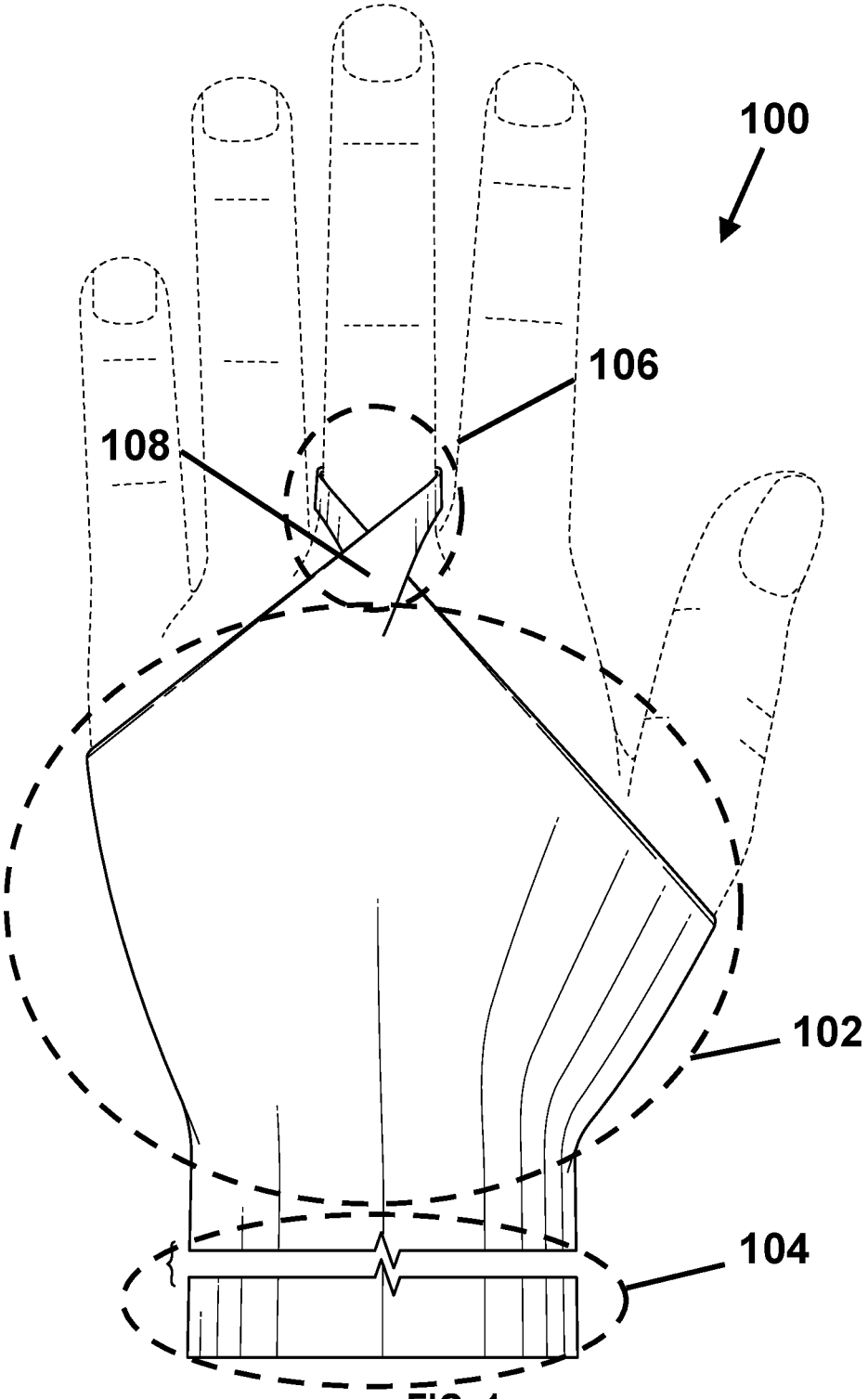
FIG. 1 is a dorsal plan view of an open-palm, fingerless hand protection glove, according to an embodiment.

FIG. 1 is a dorsal plan view of an open-palm, fingerless hand protection glove 100, according to an embodiment. Open-palm, fingerless hand protection glove 100 comprises a dorsal portion 102, a wrist portion 104, and a finger loop 106, where dorsal portion 102 is crisscrossed 108 proximal to finger loop 106. As shown, finger loop 106 encircles the wearer's third or middle finger. Generally speaking, crisscross 108 provides multi-directional force along an upper edge of dorsal portion 102. A break within the illustration of wrist portion 104 indicates that glove 100 can be produced in various lengths capable of extending to a wearer's wrist, forearm, elbow, bicep, armpit or anywhere in between.

Figure 2:
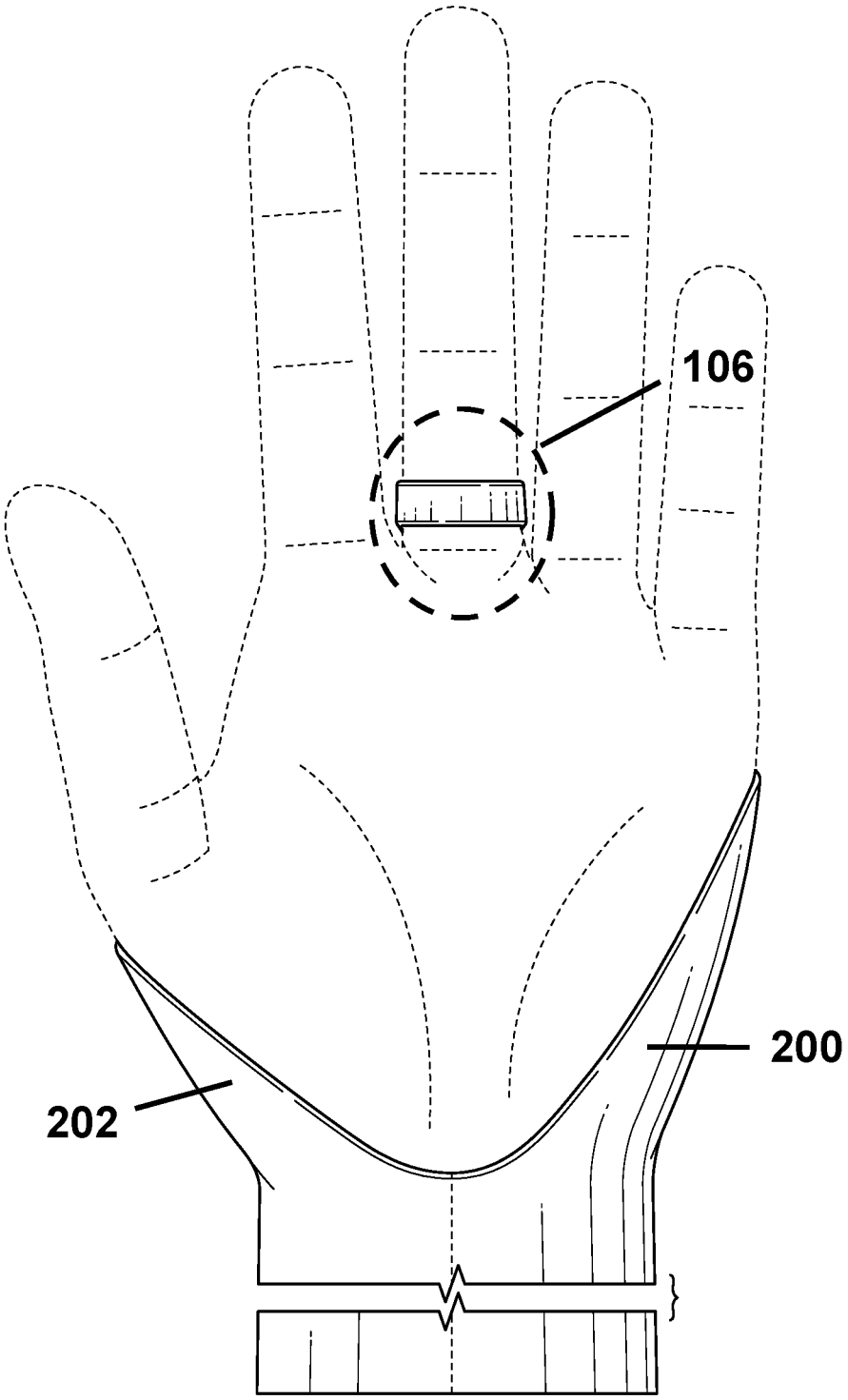
FIG. 2 is a palmar plan view of the glove of FIG. 1.
Figure 3:
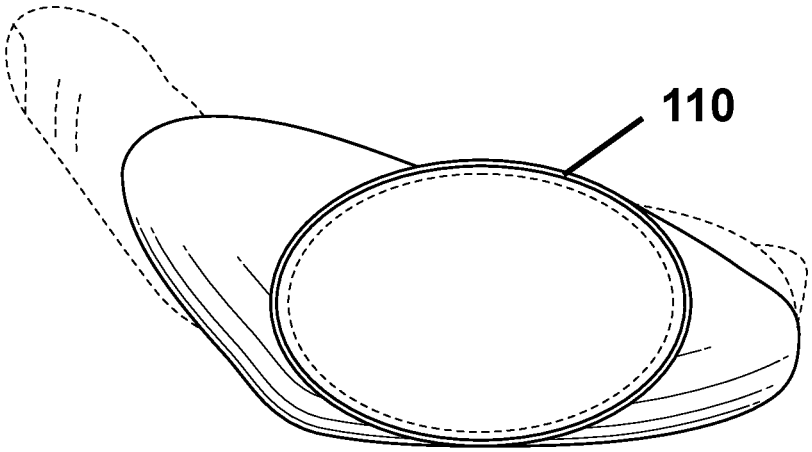
FIG. 3 is an elevation view of a wrist end of the glove of FIGS. 1 and 2.
Figure 4:
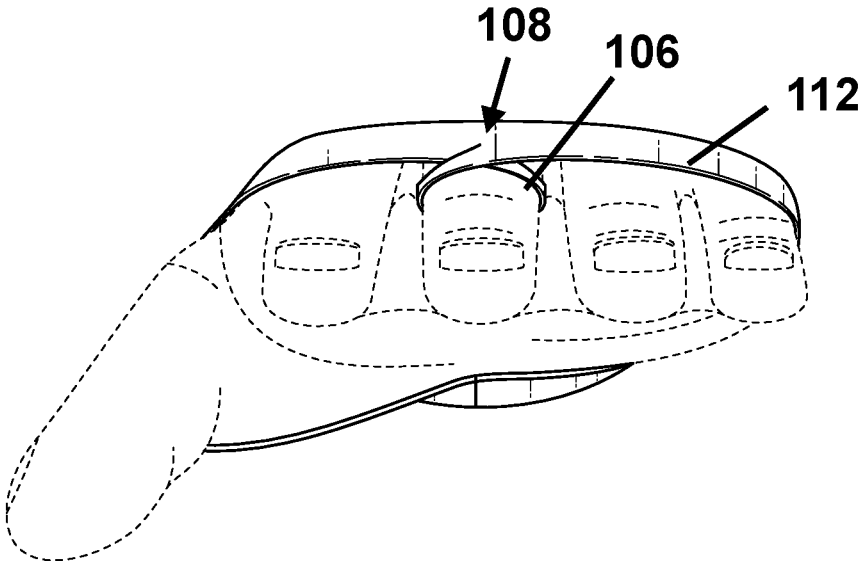
FIG. 4 is an elevation view of a finger end of the glove of FIGS. 1-3.
Figure 5:
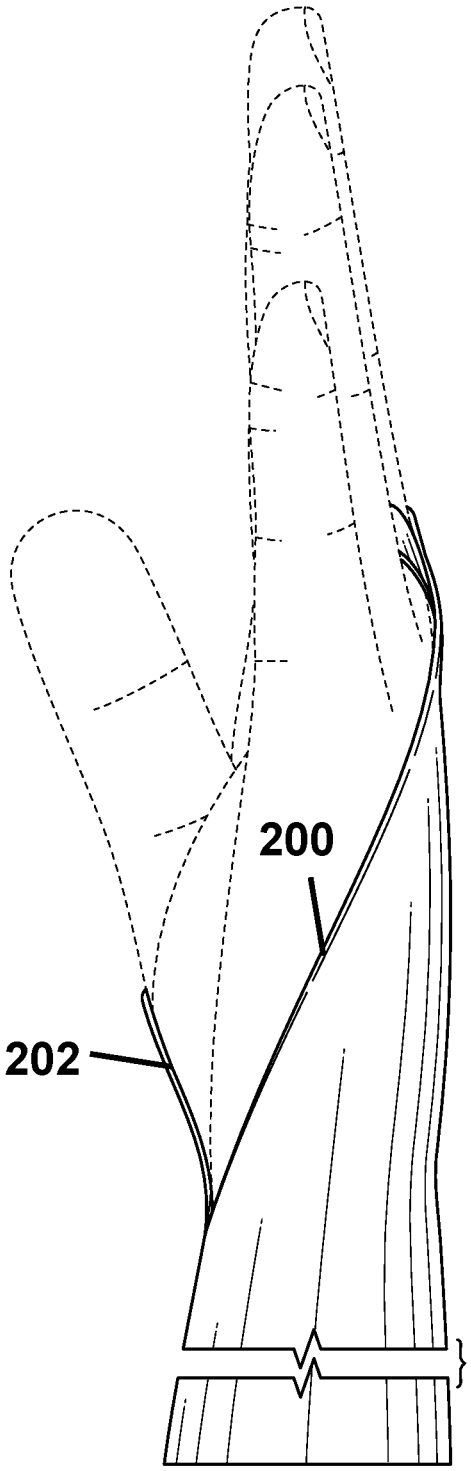
FIG. 5 is a lateral side elevation view of the glove of FIGS. 1-4.
Figure 6:
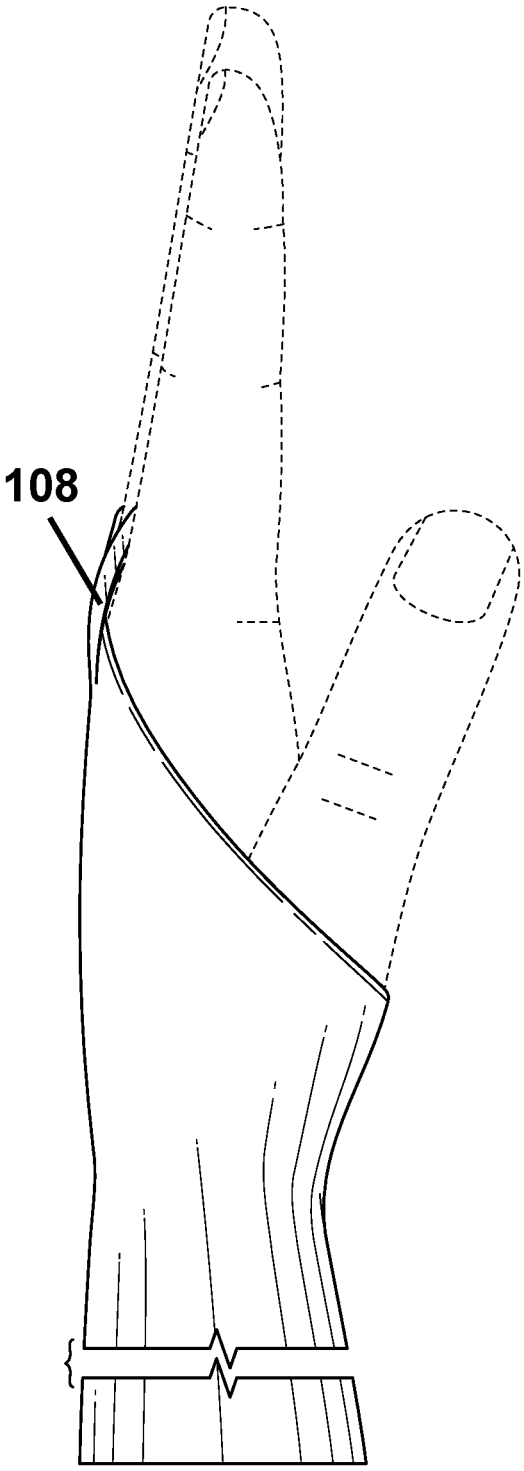
FIG. 6 is a medial side elevation view of the glove of FIGS. 1-5.

FIG. 2 is a palmar plan view of glove 100. As shown, dorsal portion 102 wraps along the lateral and medial edges of the wearer's hand to form lateral edge 200 and medial edge 202, but glove 100 is substantially palmless. FIG. 3 is an elevation view of a wrist end 110 of glove 100. FIG. 4 is an elevation view of a finger end 112 of glove 100. FIG. 5 is a lateral side elevation view of glove 100, and FIG. 6 is a medial side elevation view of glove 100. FIGS. 5 and 6 further illustrate partial wrapping of glove 100 along lateral and medial edges 200, 202 of the wearer's hand.

Figure 7:
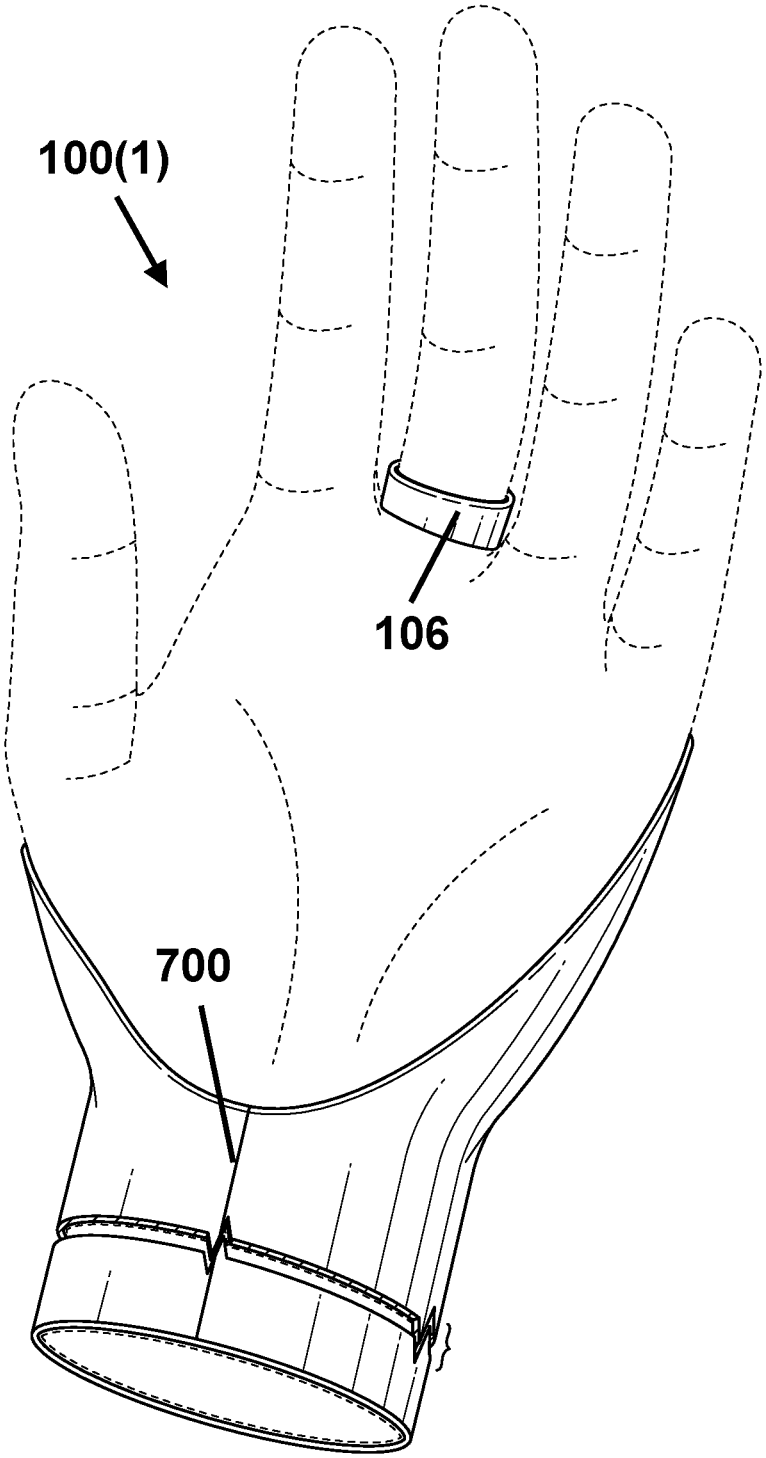
FIG. 7 is a palmar plan view of a first version of the glove shown in FIGS. 1-6.

FIG. 7 is a palmar plan view of a first version 100(1) of glove 100, wherein glove 100(1) is joined edge-to-edge along a seam 700.

Figure 8:
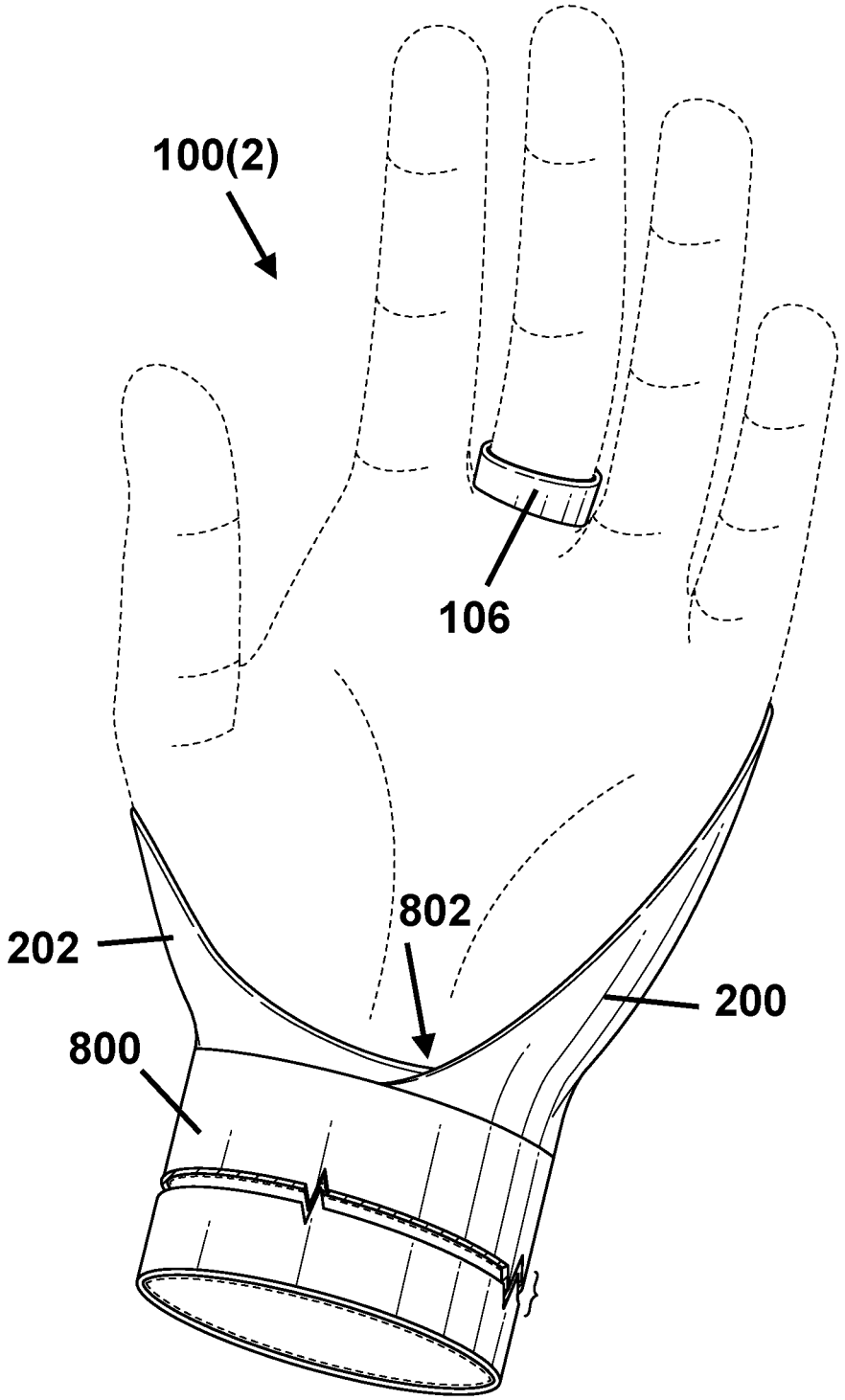
FIG. 8 is a palmar plan view of a second version of the glove shown in FIGS. 1-6.

FIG. 8 is a palmar plan view of a second version 100(2) of glove 100, wherein glove 100(2) comprises a cuff 800 that is joined to overlapping 802 lateral and medial edges 200, 202, as well as dorsal portion 102 (not shown). As shown by the illustrated break, cuff 800 may extend to a wearer's wrist, forearm, elbow, bicep, armpit or anywhere in between.

Figure 9:
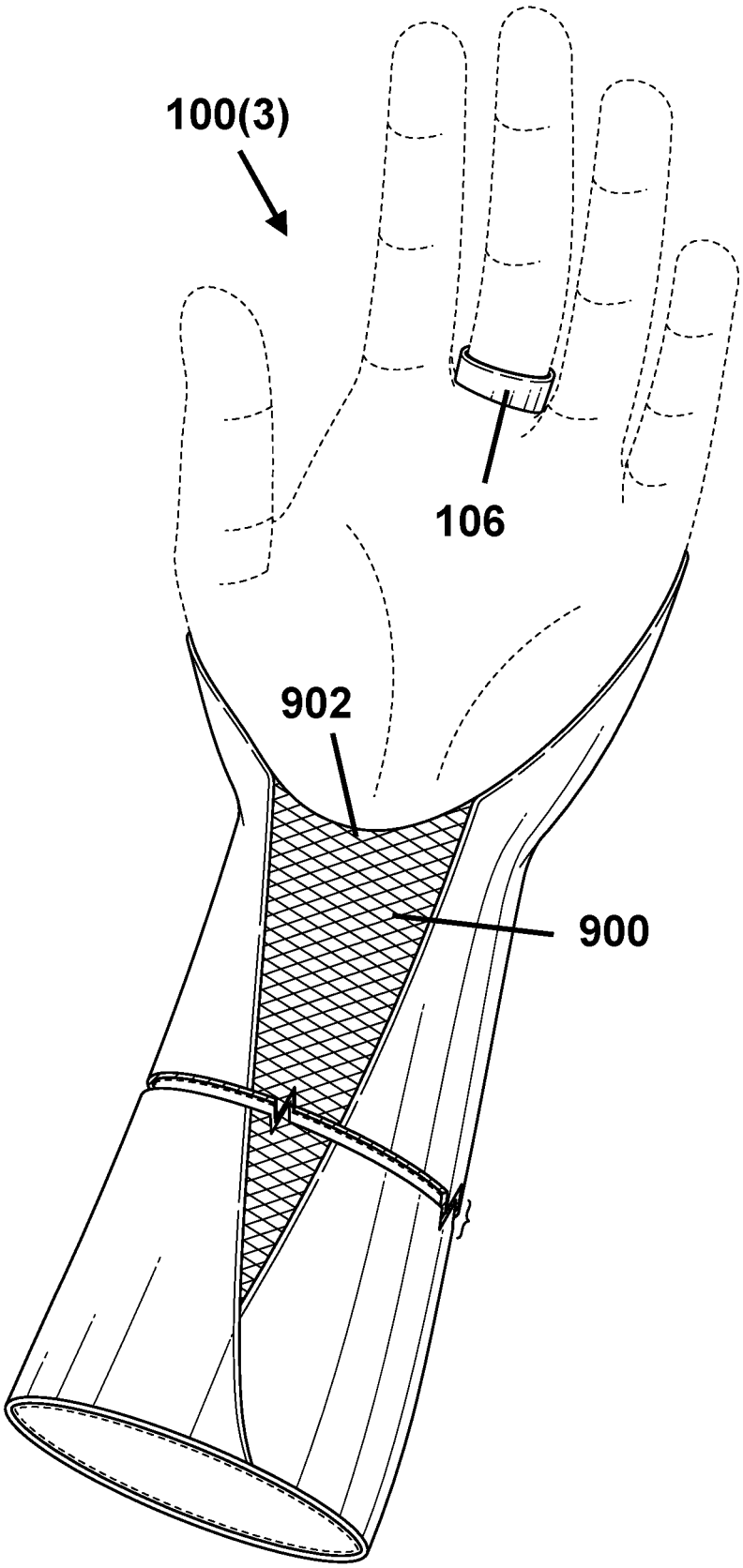
FIG. 9 is a palmar plan view of a third version of the glove shown in FIGS. 1-6.

FIG. 9 is a palmar plan view of a third version 100(3) of glove 100, wherein wrist portion 104 comprises a vent 900. As shown, vent 900, is substantially V-shaped, formed of mesh and disposed within a palmar surface of wrist portion 104. Vent 900 terminates at a hand seam 902 of glove 100(3).

Figure 10:
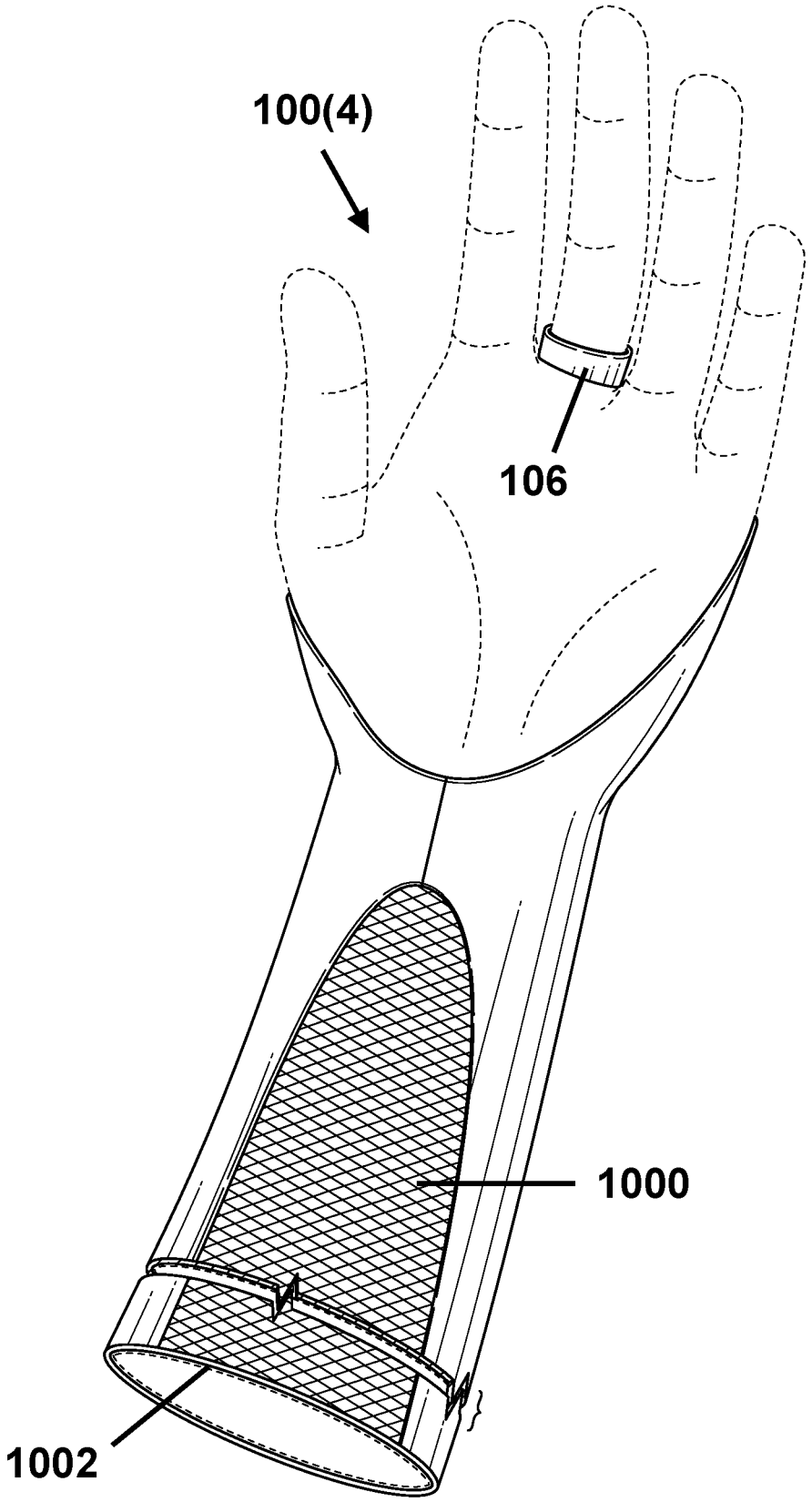
FIG. 10 is a palmar plan view of a fourth version of the glove shown in FIGS. 1-6.

FIG. 10 is a palmar plan view of a fourth version 100(4) of glove 100, wherein wrist portion 104 comprises a vent 1000. As shown, vent 1000 is substantially U-shaped, formed of mesh and disposed within a palmar surface of wrist portion 104. Vent 1000 terminates at an arm seam 1002 of glove 100(4).

Figure 11:
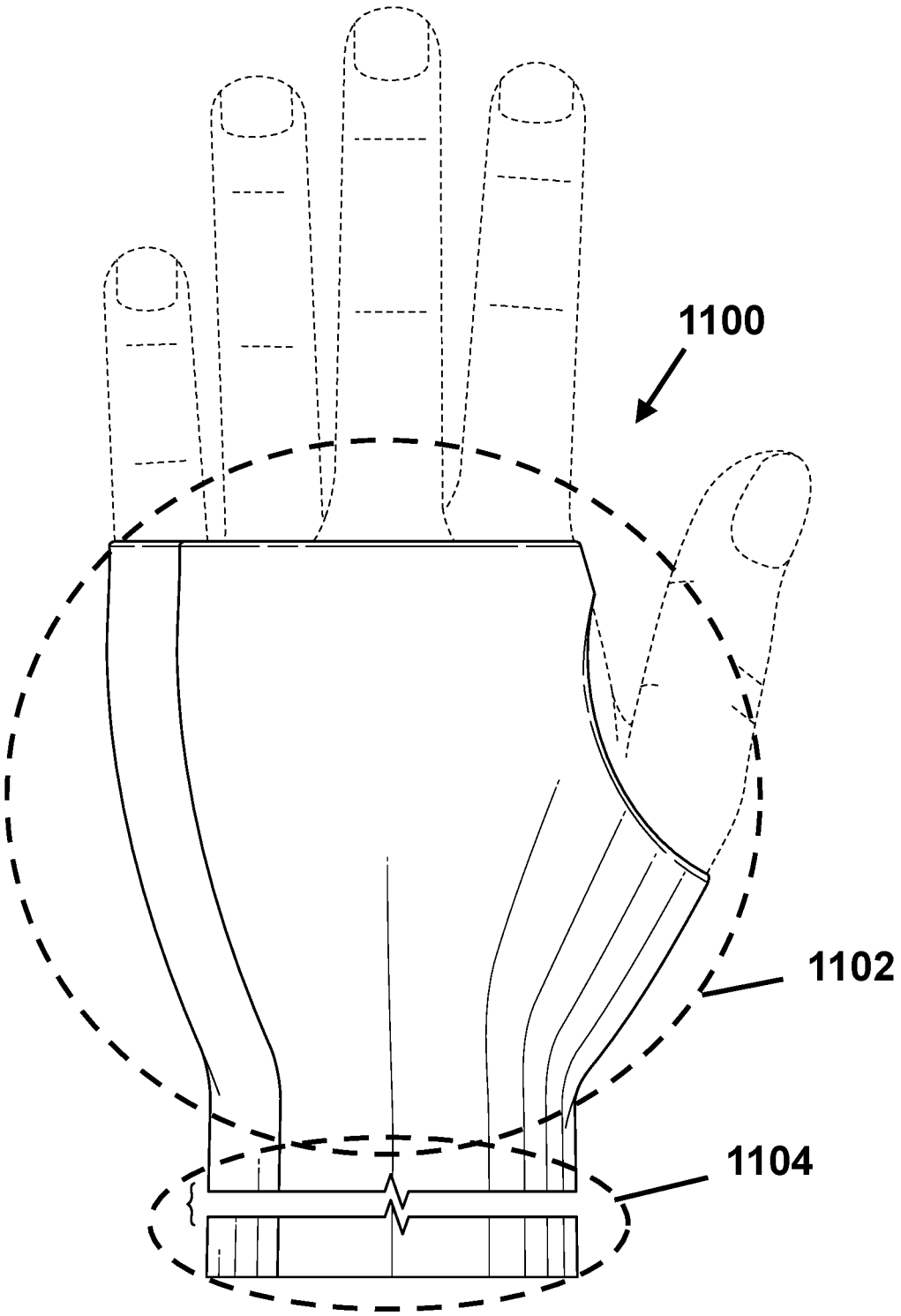
FIG. 11 is a dorsal plan view of an open-palm, fingerless hand protection glove, according to an embodiment.

FIG. 11 is a dorsal plan view of an open-palm, fingerless hand protection glove 1100, according to an embodiment. Open-palm, fingerless hand protection glove 1100 comprises a dorsal portion 1102, a wrist portion 1104, and a finger loop 1106 (not shown). In the embodiment shown, dorsal portion 1102 of glove 1100 is not crisscrossed proximal to finger loop 1106. A break within the illustration of wrist portion 1104 indicates that glove 1100 can be produced in various lengths capable of extending to a wearer's wrist, forearm, elbow, bicep, armpit or anywhere in between.

Figure 12:
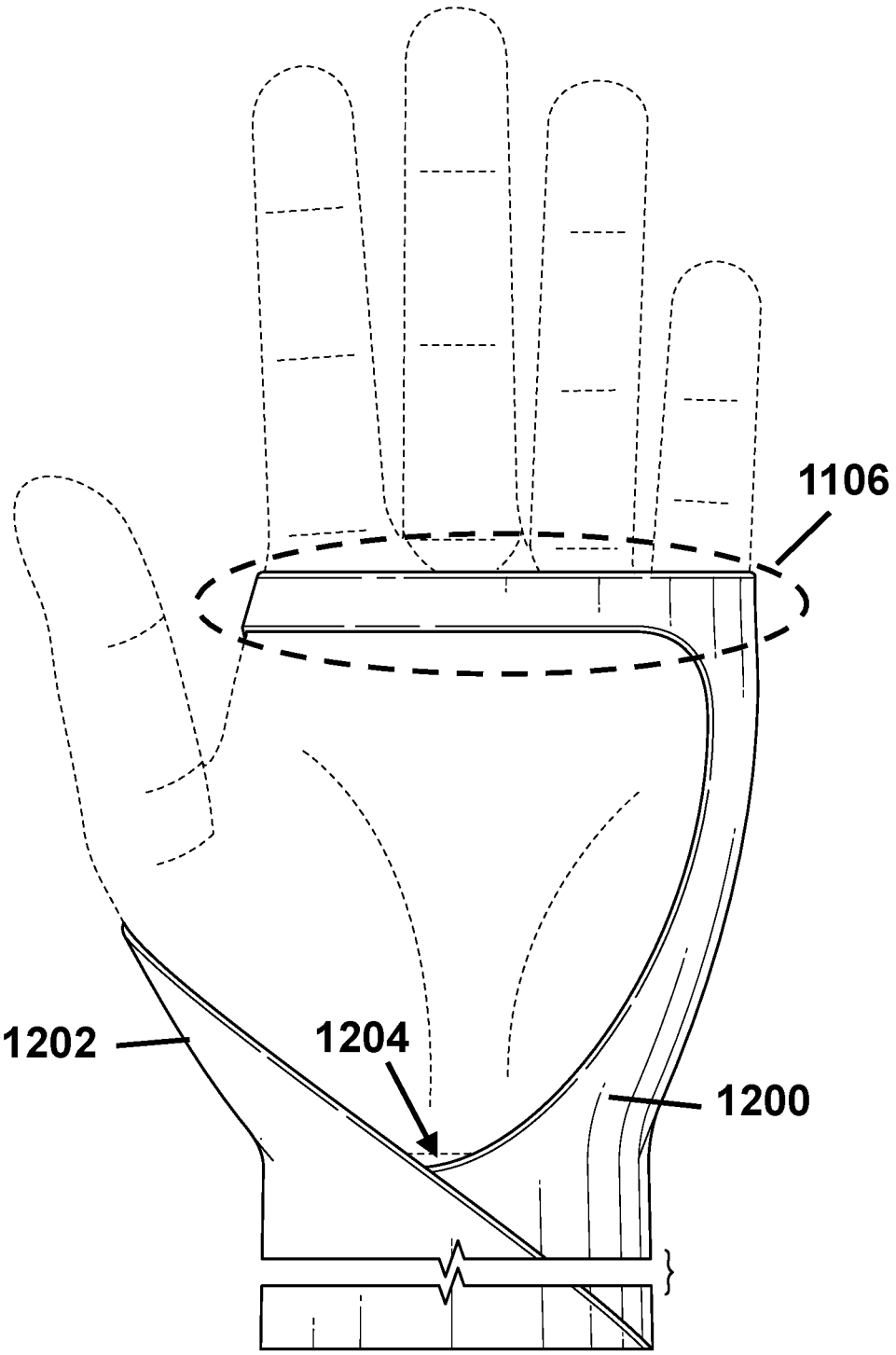
FIG. 12 is a palmar plan view of the glove of FIG. 11.
Figure 13:
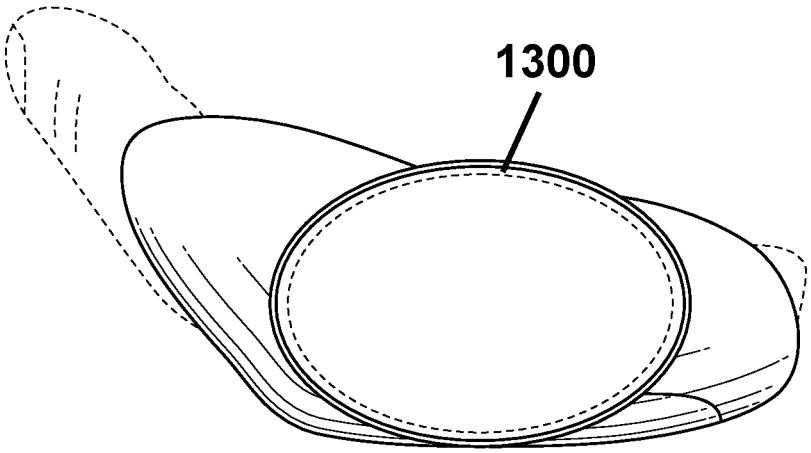
FIG. 13 is an elevation view of a wrist end of the glove of FIGS. 11 and 12.
Figure 14:
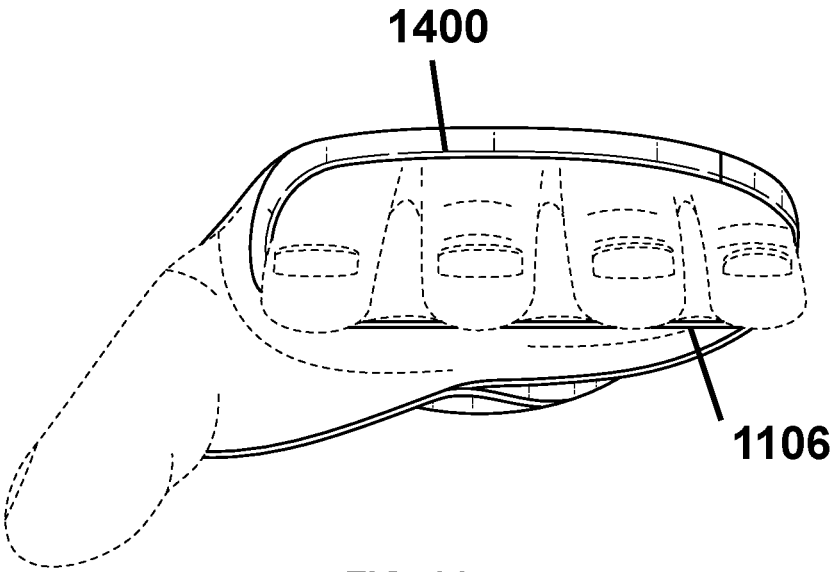
FIG. 14 is an elevation view of a finger end of the glove of FIGS. 11-13.
Figure 15:
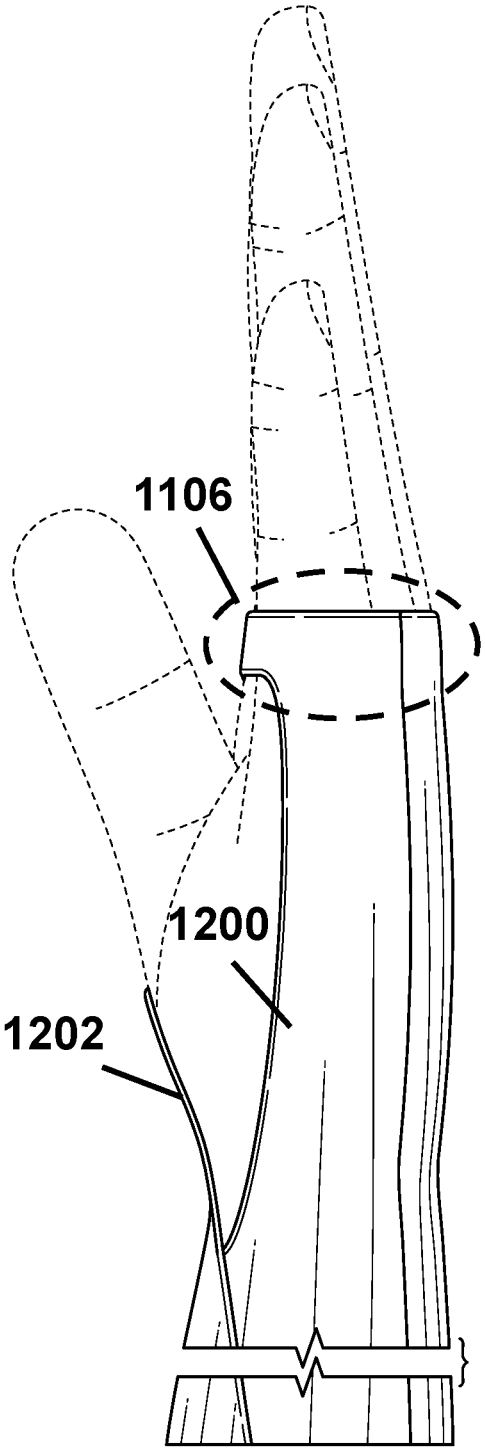
FIG. 15 is a lateral side elevation view of the glove of FIGS. 11-14.
Figure 16:
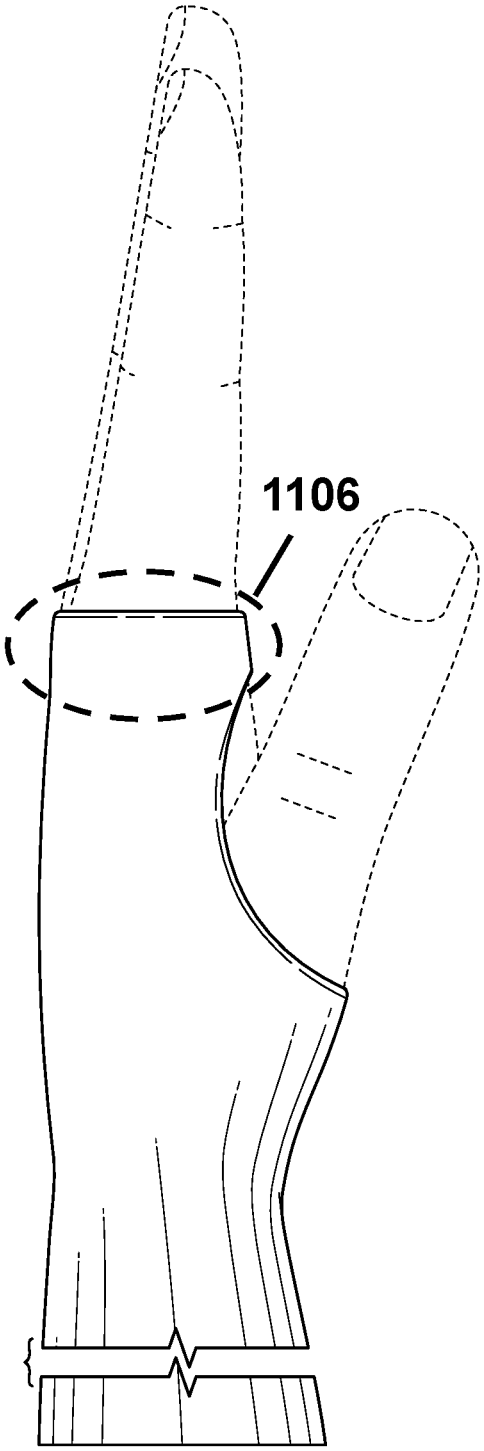
FIG. 16 is a medial side elevation view of the glove of FIGS. 11-15.

FIG. 12 is a palmar plan view of glove 1100. As shown, dorsal portion 1102 wraps along the lateral and medial edges of the wearer's hand to form overlapping 1204 lateral edge 1200 and medial edge 1202, but glove 1100 is substantially palmless. Finger loop 1106 encircles the wearer's first through fourth fingers. FIG. 13 is an elevation view of a wrist end 1300 of glove 1100. FIG. 14 is an elevation view of a finger end 1400 of glove 1100. FIG. 15 is a lateral side elevation view of glove 1100, and FIG. 16 is a medial side elevation view of glove 1100. FIGS. 15 and 16 further illustrate partial wrapping of glove 1100 along lateral 1200 and medial 1202 edges of the wearer's hand.

Those of skill in the art will appreciate that although glove 1100 is shown with distal and medial edges 1200, 1202 that overlap in a palmar region of the wrist portion other configurations, such as those comprising edge-to-edge seams and distal or palmar vents are also suitable for glove 1100.

STATEMENTS REGARDING INCORPORATION BY REFERENCE AND VARIATIONS

All references cited throughout this application, for example patent documents including issued or granted patents or equivalents; patent application publications; and non-patent literature documents or other source material; are hereby incorporated by reference herein in their entireties, as though individually incorporated by reference.

All art-known functional equivalents of materials and methods are intended to be included in this disclosure. The terms and expressions which have been employed herein are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the invention has been specifically disclosed by preferred embodiments, exemplary embodiments and optional features, modification and variation of the concepts herein disclosed can be resorted to by those skilled in the art, and that such modifications and variations are considered to be within the scope of this invention as defined by the appended claims. The specific embodiments provided herein are examples of useful embodiments of the invention and it will be apparent to one skilled in the art that the invention can be carried out using a large number of variations of the devices, device components, and method steps set forth in the present description. As will be apparent to one of skill in the art, methods and devices useful for the present methods and devices can include a large number of optional composition and processing elements and steps.

When a group of substituents is disclosed herein, it is understood that all individual members of that group and all subgroups are disclosed separately. When a Markush group or other grouping is used herein, all individual members of the group and all combinations and subcombinations possible of the group are intended to be individually included in the disclosure.

It must be noted that as used herein and in the appended claims, the singular forms "a", "an", and "the" include plural reference unless the context clearly dictates otherwise. Thus, for example, reference to "a fastener" includes a plurality of such fasteners and equivalents thereof known to those skilled in the art, and so forth. As well, the terms "a" (or "an"), "one or more" and "at least one" can be used interchangeably herein. It is also to be noted that the terms "comprising", "including", and "having" can be used interchangeably. The expression "of any of claims XX-YY" (wherein XX and YY refer to claim numbers) is intended to provide a multiple dependent claim in the alternative form, and in some embodiments is interchangeable with the expression "as in any one of claims XX-YY."

Unless defined otherwise, all technical and scientific terms used herein have the same meanings as commonly understood by one of ordinary skill in the art to which this invention belongs. Although any methods and materials similar or equivalent to those described herein can be used in the practice or testing of the present invention, the preferred methods and materials are described. Nothing herein is to be construed as an admission that the invention is not entitled to antedate such disclosure by virtue of prior invention.

Whenever a range is given in the specification, for example, a range of integers, a temperature range, a time range, a composition range, or concentration range, all intermediate ranges and subranges, as well as all individual values included in the ranges given are intended to be included in the disclosure. As used herein, ranges specifically include the values provided as endpoint values of the range. As used herein, ranges specifically include all the integer values of the range. For example, a range of 1 to 100 specifically includes the end point values of 1 and 100. It will be understood that any subranges or individual values in a range or subrange that are included in the description herein can be excluded from the claims herein.

As used herein, "comprising" is synonymous and can be used interchangeably with "including," "containing," or "characterized by," and is inclusive or open-ended and does not exclude additional, unrecited elements or method steps. As used herein, "consisting of" excludes any element, step, or ingredient not specified in the claim element. As used herein, "consisting essentially of" does not exclude materials or steps that do not materially affect the basic and novel characteristics of the claim. In each instance herein any of the terms "comprising", "consisting essentially of" and "consisting of" can be replaced with either of the other two terms. The invention illustratively described herein suitably can be practiced in the absence of any element or elements or limitation or limitations which is/are not specifically disclosed herein.

What is claimed is:

1. An open-palm, fingerless hand protection glove comprising:

a dorsal portion;

an open palm area;

a wrist portion; and at least one finger loop configured to surround multiple fingers;

wherein the glove does not comprise material for a palmar surface of a wearer's thumb.

2. The glove of claim 1, wherein the multiple fingers are all of a wearer's first through fourth fingers.

3. The glove of claim 1, wherein a finger end of the glove is substantially linear.

4. The glove of claim 1, wherein the at least one finger loop forms a palmar finger end of the glove.

5. The glove of claim 1, wherein the at least one finger loop forms a palmar finger end of the glove and spans between a lateral edge and a medial edge of the glove.

6. The glove of claim 1, wherein the dorsal portion is configured to cover at least 80% of the back of a wearer's hand.

7. The glove of claim 1, wherein the dorsal portion is formed of ultraviolet (UV) protective material.

8. The glove of claim 7, wherein the UV protective material has an ultraviolet protection factor (UPF) of at least 15.

9. The glove of claim 7, wherein the UV protective material is a recycled or raw material selected from the group consisting of cotton, linen, hemp, polyester, nylon, spandex, polypropylene, denim, twill, canvas, wool, leather and combinations thereof.

10. The glove of claim 7, wherein the UV protective material is moisture wicking.

11. The glove of claim 7, wherein the UV protective material comprises an antibacterial agent.

12. The glove of claim 1 further comprising a second material attached to at least a portion of an internal surface of the glove to produce a reversible glove that can be worn on an opposite hand.

13. The glove of claim 12, wherein the second layer of material is UV protective material or wherein the second layer of material is not UV protective material.

14. The glove of claim 1, wherein the wrist portion is sewn, hook and loop fastened, tied, crisscrossed, elastic, buttoned, snapped, magnetic, mechanically fastened, ultrasonically welded and/or laser-cut as one piece.

15. The glove of claim 1, wherein the wrist portion has a length between 0.5 inches and 36 inches.

16. The glove of claim 1, wherein the wrist portion comprises a cuff.

17. The glove of claim 1, wherein the wrist portion comprises a vent.

18. The glove of claim 17, wherein the vent is disposed within a palmar surface of the wrist portion, a distal surface of the wrist portion or both.

19. The glove of claim 17, wherein the vent comprises mesh and/or sheer material.

20. The glove of claim 17, wherein the vent terminates at a hand seam, an arm seam or both.

* * * * *